US005205740A

United States Patent [19]

Frankeny et al.

[11] Patent Number: 5,205,740

[45] Date of Patent: Apr. 27, 1993

[54] SUPER CONNECTOR FOR CONNECTING FLAT RIBBON CABLES

[75] Inventors: Richard F. Frankeny, Austin, Tex.; Karl Hermann, Romulus, N.Y.; Ronald E. Hunt, Georgetown; Verlon E. Whitehead, Austin, both of Tex.

[73] Assignee: International Business Machines, Corp., Armonk, N.Y.

[21] Appl. No.: 808,261

[22] Filed: Dec. 13, 1991

[51] Int. Cl.[5] ..... H01R 9/09

[52] U.S. Cl. ..... 439/67; 439/77; 439/465; 439/499

[58] Field of Search ..... 439/67, 77, 329, 260, 439/261, 267, 372, 377, 460–462, 465, 467, 469, 492, 493, 498, 499, 630

[56] References Cited

U.S. PATENT DOCUMENTS

| | | | |
|---|---|---|---|
| 4,690,472 | 9/1987 | Elco et al. | 439/67 |
| 4,787,854 | 11/1988 | Le Parquier | 439/67 |
| 4,824,379 | 4/1989 | Roberts et al. | 439/77 |
| 4,975,068 | 12/1990 | Squires | 439/67 |
| 5,007,856 | 4/1991 | Puerner | 439/465 |

*Primary Examiner*—Paula A. Bradley

*Attorney, Agent, or Firm*—Laurence R. Letson

[57] ABSTRACT

A connector for connecting large numbers of contact points on a flat ribbon cable to corresponding contact points on a second flat ribbon ribbon cable is described. The connector is a rigid clamping device which encompasses the cables where they join and through the use of springs and force spreaders the connections at the cable interface are completed. The connections of the cables are disposed within a chamber within the connector and rigidly clamped to prevent movement or separation of the connections.

16 Claims, 3 Drawing Sheets

SUPER CONNECTOR FOR CONNECTING FLAT RIBBON CABLES

FIELD OF THE INVENTION

This invention relates to the field of connectors for interconnecting flat ribbon cables with large numbers of conductors and, specifically, for connecting flat ribbon cables by clamping or forcing the ribbon cables in a face-to-face relationship to create the connection.

RELATED PATENT APPLICATIONS

The ribbon cables that may be connected by this invention may typically be of the type disclosed in copending patent application Ser. No. 07/459,087, filed Dec. 29, 1989, now U.S. Pat. No. 5,121,299, entitled "Multi-Level Circuit Structure and Method For Construction Thereof", by Richard Francis Frankeny and Karl Hermann; and Ser. No. 07/724,245, filed Jul. 1, 1991, entitled "High Density Substrate Design and Manufacturing Process", by R. F. Frankeny et al, both applications being commonly assigned herewith.

BACKGROUND OF THE INVENTION

In the design of computer architecture, particularly in the area of parallel processing computers were multiple processors are used to simultaneously perform many operations, there exists a need for an exceedingly large number of interconnections where cables are joined together. Reliability is a key factor in consideration of connection technology. However, size constraints dictate that massive numbers of connections must be made in a very small area. For example, a single ribbon cable may have as many as twenty-four hundred (2400) conductors which need to be connected to twenty-four hundred (2400) corresponding conductors on a second cable. These connections must be made quickly and reliably in order to insure efficient assembly and/or repair. Further cable conductors must be maintained as close to a uniform length as may be possible in order to not unduly delay signals on some conductors with respect to the signal delay on other conductors. The mating of flexible cables in a face-to-face relationship for purposes of connecting one cable to another is disclosed in U.S. Pat. No. 4,975,068 issued to John J. Squires. The Squires patent discloses and describes a clamp member for trapping the ends of two cables and forcing the contact points on the end of each respective cable against the contact points of the other cable. The clamp member is in the form of a hinge wherein the plates of the hinge trap and hold the cable ends in juxto-position.

U.S. Pat. No. 4,787,854 to Le Parquier discloses another device for trapping and clamping flat ribbon cables in face-to-face connecting fashion using a resilient seal such as an elastomeric cylinder to provide the engaging force necessary to connect the facing contact points on the ribbon cables.

The Squires patent relies upon the physical clamping force generated by the clamp and the resilience of an elastomeric sheet or pad to engage all of the contact points between the two ribbon cables. The clamp member of the Squires patent provides the desired force over an area only if the thickness of the ribbon cables and the elastomeric pad are closely controlled and uniform. In the event of non-uniformity, the clamping forces may not be sufficient to establish and maintain a reliable electrical contact between the ribbon cables.

SUMMARY OF THE INVENTION

The present invention overcomes the drawbacks of the prior devices in that it allows the interconnection of massive numbers of conductors, while at the same time, provides a localized force to insure that slight variations of thickness in the ribbon cable structure do not prevent reliable connections between all contact points on the ribbon cables.

The present invention also provides sufficient localized force to make massive numbers of connections in a very limited area. The forces necessary to make the massive number of connections is provided by extremely strong and stiff leaf spring fingers acting through pins to exert a force onto an area of a plate which acts to spread the force over the localized region.

The present invention is a frame member which has two retaining member portions. The two retaining member portions create a chamber or cavity within which the overlapped ends of the ribbon cable together with an elastomeric sheet and a plate on one side of one ribbon cable and a second plate on the other side of the ribbon cable may be inserted. One of the plates is provided with a raised portion positioned coincident with the contact region at every contact point in the array of interconnections. The other plate and the elastomeric sheet are positioned so that the elastomeric sheet and the second ribbon cable are adhesively attached with the plate adhesively attached to the opposite face of the elastomeric sheet. A comb of spring fingers in the form of leaf springs is provided to create the engagement force between the contact points on the respective ribbon cables. Near its end each leaf spring of the comb carries a pin with a rounded nose. This pin and rounded nose extend from the outside of the frame, through holes, into the chamber and engage the plate attached to the elastomeric sheet and transmit the force of the leaf spring to the plate member. Providing backing and additional biasing forces to the leaf springs of the comb are additional leaf springs which are ganged and clamped to act on the leaf springs carrying the force transmission members or pins. A camming member is provided to cam the leaf springs out of engagement with the plate member so that the overlapped ribbon cable ends and their associated plates and elastomeric sheet may be inserted or removed into or out of the cavity of the connector. When positioned in the desired arrangement, the camming member may then be rotated to release the springs to act to force the two ribbon cable faces into contact with each other completing the connection. The open end of the frame is contained within an end cap to prevent undue spreading of the legs of the frame.

The precise placement of contact points on the flexible ribbon cables permits vast numbers of interconnects simply and quickly using this connector device. The advantages of this invention will be clear from the drawings and the description to follow.

DESCRIPTION OF THE PREFERRED EMBODIMENT OF THE BEST MODE FOR CARRYING OUT THE INVENTION

Figure 1:
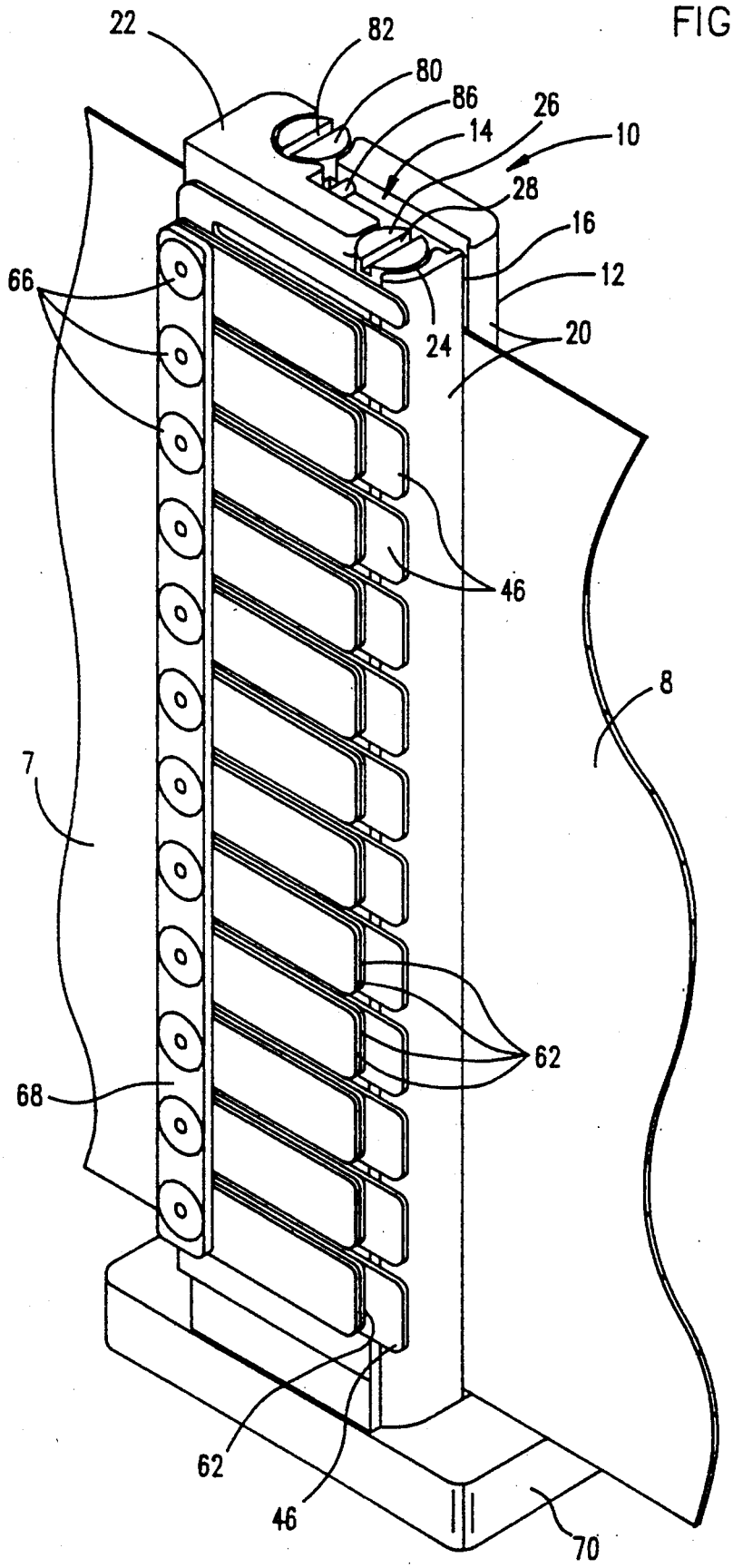
FIG. 1 is a perspective view of the assembled connector and ribbon cables.

With reference to FIG. 1, the connector for the flat ribbon cables is illustrated in its assembled and complete condition.

Connector 10 is comprised of a frame member 12. Frame 12 has a long axis which is vertically oriented in FIG. 1. Further, frame 12 has a chamber 14 formed extending parallel to the long axis of connector 10. Chamber 14 communicates with the exterior of the connector 10 through slots 16 and slot 18, not visible in FIG. 1 but shown in FIG. 2. Slots 16 and 18 provide a path by which ribbon cables 8 and 7 may enter chamber 14. Legs 20 or retaining members 20 of frame 12 are joined together only at the top, in region 22. The opposite or bottom end of connector 10 is open and the two retaining members 20 are not joined at the bottom of the assembly. The lack of the retaining members 20 being joined at the bottom end of frame 12 permits the ribbon cables 7, 8 and the other elements attached to the ribbon cables 7, 8 to be inserted within chamber 14 as will be described later.

Extending parallel to the axis of connector 10 is a camming member 24 having a head 26 and slot 28. The camming member 24 is substantially cylindrical in shape, with the exception of a flat 60 formed on the periphery thereof to form a cam rise. This can be best seen in FIG. 2 and will be described in more detail later. Head 26 is cylindrical to permit rotation while slot 28 permits the engagement of a screwdriver or other similar tool to rotate camming member 24. Cam member 24 is the means by which clamping action of the connector assembly 10 may be relieved to permit the insertion of flat ribbon cables 7 and 8 into chamber 14 and then releasing the clamping forces to engage the two ribbon cables, 7, 8 in a face-to-face interconnecting fashion.

Figure 2:
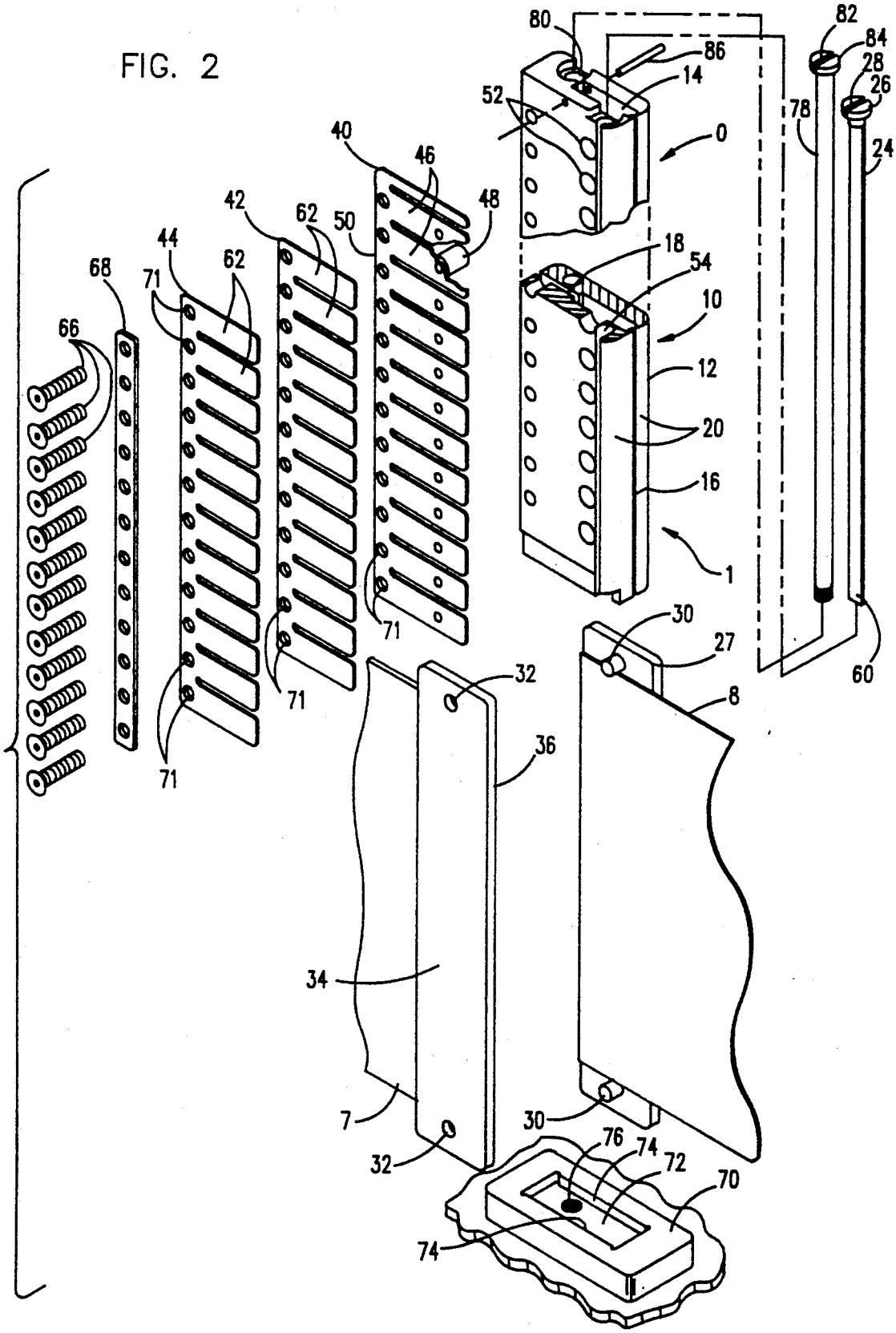
FIG. 2 is an exploded perspective view of the connector and ribbon cables.
Figure 3:
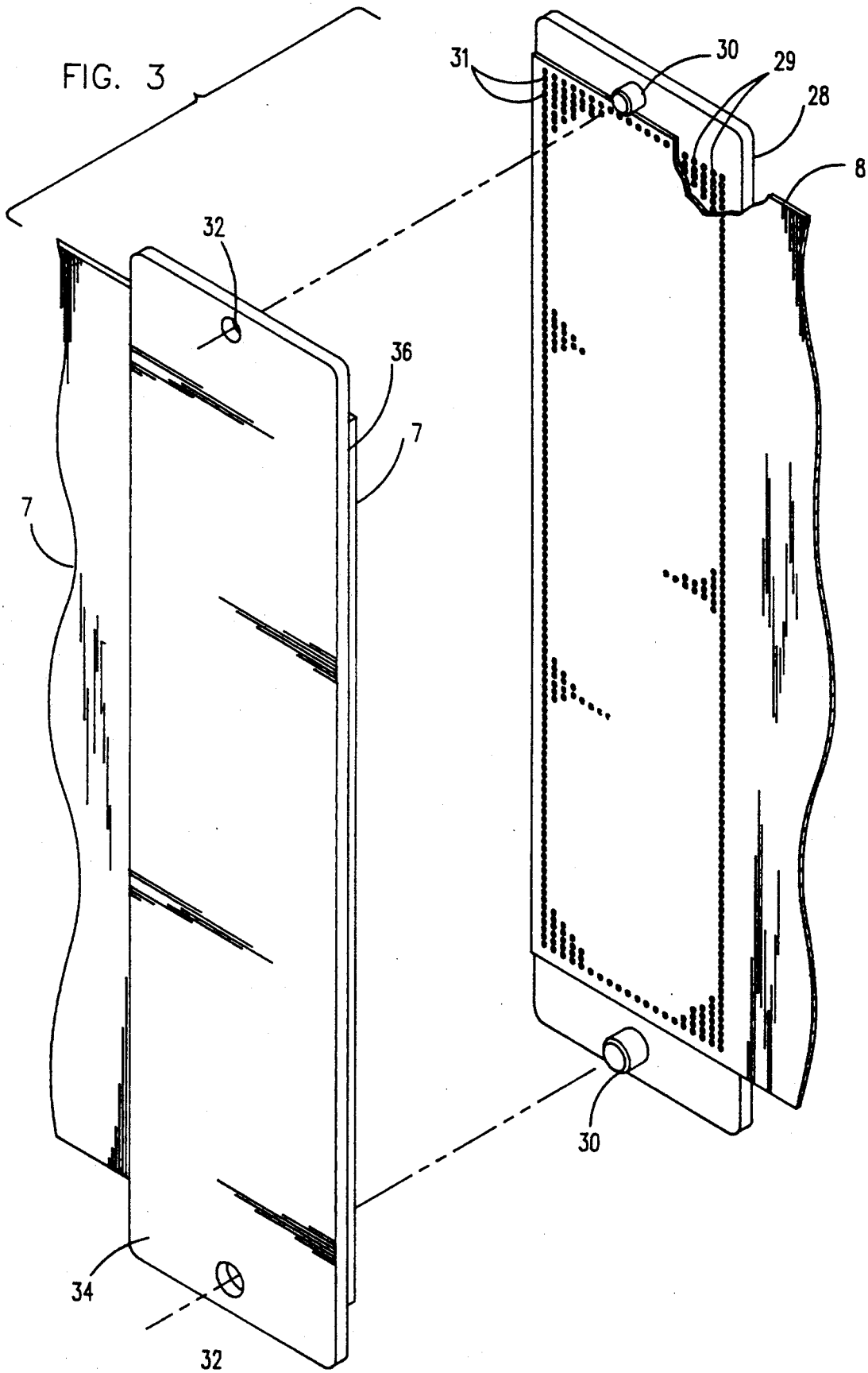
FIG. 3 is an enlarged view showing the interconnect matrix of contact points together with the plates and elastomer which form the interconnect region.

In order to reliably interconnect ribbon cable 7, 8 in face-to-face contact, reference is made to FIGS. 2 and 3. Specifically with reference to FIG. 3, plate 27 is adhesively adhered to the backside or non-contact side of ribbon cable 8. Plate 27 may be made of a plastic material and is provided with a vast number of raised projections 29 on the surface of plate 27 which correspond precisely to the interconnection locations to be completed between cable 8 and cable 7.

Plate 27 is provided with locating pins 30 which in turn will mate with locating holes 32 on plate 34. Plate 27 is adhesively attached in a permanent fashion to ribbon 8. Referring now to ribbon 7, the plate 34 is positioned and attached by means of an intermediate elastomeric layer 36 to the reverse or insulated side of ribbon cable 7. The three elements, plate 34, elastomeric layer 36 and ribbon 7 are all adhesively attached to prevent relative motion between the three elements.

The elastomeric layer provides a localized elastic resilient force to urge the surface of ribbon cable 7 against the surface of ribbon cable 8, particularly in the regions where the surface of ribbon cable 8 has been raised by virtue of the projections 29 on the face of plate 28.

The location of pins 30 and locator holes 32 is of significant consideration because the pin 30 and hole 32 locator precision effect the precision in placing corresponding contact points on ribbon cable 7 over contact points on ribbon cable 8, since the preferred embodiment of this invention is capable of connecting twenty-four hundred (2400) interconnections in a matrix of twenty (20) by one hundred twenty (120) contact points 31. The rows and columns of contacts 31 are preferably positioned on one millimeter centers so that the overall matrix approximates twenty (20) millimeters wide by one hundred twenty (120) millimeters long.

Referring now to FIGS. 1 and 2, the force necessary to forceably engage the faces of ribbon cables 7, 8 is provided by a leaf spring assembly which is comprised of primary leaf spring comb 40 which is supplemented by secondary leaf spring combs 42, 44. Leaf spring comb 40 is comprised of leaf springs 46 which carry, near their distal ends, force transmission members 48 in the form of round nose pins 48 attached to the ends of leaf springs 46, only one of which is shown for clarity. The ends of leaf springs 46 all are joined together on the comb backing 50 for mounting purposes.

Frame 12 connector 10 is provided with a plurality of holes 52 extending from the exterior of the frame 12 to the chamber 14. These holes 52 are each spaced and positioned to have an axis that corresponds to the axis of each pin 48 such that pins 48 may be inserted through holes 52 to engage plate 34 attached to ribbon cable 7.

Leaf springs 46 overlie a channel 54 formed longitudinally and parallel to the axis of frame 12. The distal ends of the leaf springs 46 when positioned on frame 12 overlie the exposed portion of channel 54. Inserted within channel 54 is camming member 24 which is substantially cylindrical in cross-section with a flat 60 formed thereon. Flat 60 is preferably relieved from the surface of member 24 to cause disengagement from the distal ends of springs 46. Rotation of camming member 24 will have a camming effect as flat 60 is rotated, thus lifting the ends of spring fingers 46 away from frame 12 of the connector 10. As the springs 46 are lifted away from frame 12, pins 48 will be retracted from engagement with plate 34, thus relieving the face-to-face engagement forces between ribbon cables 7, 8.

Leaf spring combs 42 and 44 have shorter length leaf spring fingers 62. Leaf spring combs 42 and 44 will have uniform length fingers on each respective comb; however, the length of the fingers between combs 42 and 44 either may be uniform or variable depending upon the forces desired to be exerted onto leaf springs 46 and, correspondingly, pin 48. Leaf spring combs 40, 42 and 44 are attached to frame 12 by means of a series of screws 66 and a clamping plate 68. Screws 66 pass through the holes 71 formed in the backbone of leaf spring combs 40, 42 and 44. Leaf spring combs 42 and 44 supplement the rigidity of the leaf spring comb 40 by adding additional stiffness and, thereby, permit the forces on pins 48 to be substantially greater than that which would be possible with only a single leaf spring comb 40.

Frame 12 is preferably manufactured from a molded plastic material for cost and manufacturing considerations. One will readily appreciate that the legs or retaining members 20 of frame 12 will tend to spread at the bottom or unattached end of connector 10 under the influence of the force exerted by leaf spring combs 40, 42 and 44. Accordingly, it is desirable to retain the lower ends or free ends of frame 12 in closely controlled spatial relationship to each other in order to insure reliable interconnections between ribbon cable 7, 8, particularly at the lower edges of the ribbon cables 7, 8. To accomplish this spatial retention, end cap 70 is provided. End cap 70 is further provided with a recess 72 within which the free ends of retaining members 20 are inserted. The walls 74 of recess 72 will prevent the spreading of the free ends of retaining members 20 when the spring force is engaged with plate 34 on ribbon cable 7. To retain end cap 70 on connector 10 and in contact with the free ends of retaining member 20, end cap 70 may be provided with a threaded aperture 76 and the connector 10 provided with a long threaded retaining screw or bolt 78 which is inserted into hole 80 which runs parallel to the axis of the connector 10. After the connector 10 and cables 7, 8 have been assembled, the free ends of retaining members 20 may be inserted into end cap 70 and retaining bolt 78 threaded into threaded aperture 76 completing the assembly of the connector 10. Retaining bolt 78 is provided with a head 84 and slot 82 for the insertion of a screwdriver or similar implement to tighten the bolt.

A convenient and efficient way to complete the assembly of connector 10 is to include the recess 72 of end cap 70 in a portion of the frame of the electronic system into which the connector 10 fits. For example, the end cap 70 may be formed as a portion of the frame of a parallel processing computer such that when the connector frame 12 is inserted into the end cap recess 72 and the retaining bolt 78 assembled and tightened, the frame 12 of the connector 10 is rigidly attached to the frame or housing of the computer of which it is a part. This advantageously reduces the cost and at the same time fixes the position of connector 10 within the electronic device or computer of which it is a part.

To assemble the connector 10 and ribbon cables 7, 8, plates 30 and 34 must first be adhesively attached to the reverse or non-contact sides of cables 8, 7 respectively. Intermediate plate 34 and ribbon cable 7, is positioned an elastomeric sheet such as a rubber pad. The rubber pad or elastomeric sheet 36 is adhesively attached to both the ribbon cable 7 and plate 34.

Then pin 30 may be inserted into hole 32 for alignment purposes; the assembly of ribbon cables 7, 8 with their associated plates 34, 27 are inserted through slots 16 and 18 into the chamber 14 by sliding plates 27, 34 into the chamber and along the axis of the chamber 14 from the free ends of retaining members 20, until such point as plates 27, 34 engage stop pin 86 which limits the extent to which plates 27, 34 may be forced into chamber 14.

In order to ease the insertion of plates 27, 34 into chamber 14, camming member 24 is rotated about its longitudinal axis to raise the distal ends of leaf springs 46 away from frame 12. In so doing, force transmission pins 48 are retracted and permit the insertion of plate 34 without undue resistance.

After the plates 27 and 34 have been inserted into chamber 14 and retaining bolt 78 inserted into channel 80 and engaged with and tightened out end cap 70, camming member 24 may be rotated to present the flat 60 to the underside of leaf springs 46 allowing their natural flexure to force pins 48 through apertures 52 and the rounded noses of pins 48 to engage plate 34. Plate 34 will act as a force spreading device inasmuch as it receives the forces of the leaf springs 46 in twelve discreet points in the preferred embodiment and the rigidity of the plate 34 will cause force to be exerted at other areas between ribbon cable 7 and ribbon cable 8 to insure engagement of all the contact points in the contact point matrix illustrated in FIG. 3.

While this type of connector is extremely advantageous with making vast numbers of interconnections, for example, twenty-four hundred (2400) in the preferred embodiment, lessor or greater numbers may be accommodated depending upon the size of the connector. For example, a mere change in length and the number of fingers 46 of the leaf spring comb 40 and force transmission pins 48 would permit larger numbers of contacts while smaller numbers of contacts may be accommodated by merely changing the pitch between contact points on the ribbon cables 7, 8 or by corresponding shrinkage of the size of the connector 10. The end cap may be fabricated as a separate element or as a part of a utilizing electronic device such as a computer frame or housing and other changes may be made to the preferred embodiment and still remain within the scope of the invention.

We claim:

1. A connector for electrically joining two electrical cables comprising:

a frame comprising a rigid member having an exterior and having a long axis disposed transverse to an axis of conductors of said cables, said rigid member comprising a pair of retaining members forming a chamber extending transverse to said long axis;

at least one slot communicating with said chamber and said exterior;

force spreading means for equalizing forces on said cables insertable within said chamber and disposed on at least one side of said cables;

spring means disposed on said frame and rigidly attached thereto;

force transmission means projecting through said frame intermediate said force spreading means and said spring means for transmitting spring force to said force spreading means;

relief means for relieving forces from said spring means against said force spreading means, thereby permitting insertion of said cables and said force spreading means into said chamber, application of said force to said cable ends to connect said conductors on said cables, and relieving said force to permit removal of said cable ends from said connector.

2. The connector of claim 1 wherein said force spreading means comprises a plate disposed transverse to one of said cables and an elastomeric material interposed between said plate and said cable.

3. The connector of claim 2 wherein said elastomeric member is attached to said plate and said cable.

4. The connector of claim 2 further comprising a plate attached to the insulated side of said second cable.

5. The connector of claim 4 wherein said plate attached to said insulated side of said second cable comprises raised regions on said surface engaged with said cable whereby said raised regions of contact are created on said cable for surface contact with said first cable.

6. A connector for electrically joining two electrical cables comprising:

a frame comprising a rigid member having an exterior and having a long axis disposed transverse to an axis of conductors of said cables, said rigid member comprising a pair of retaining members forming a chamber extending transverse to said long axis;

an end retainer engaging said retaining means for preventing spreading of said retaining means;

at least one slot communicating with said chamber and said exterior;

force spreading means for equalizing forces on said cables insertable within said chamber and disposed on at least one side of said cables;

spring means disposed on said frame and rigidly attached thereto;

force transmission means projecting through said frame intermediate said force spreading means and said spring means for transmitting spring force to said force spreading means;

relief means for relieving forces from said spring means against said force spreading means, thereby permitting insertion of said cables and said force spreading means into said chamber, application of said force to said cable ends to connect said conductors on said cables and relieving said force to permit removal of said cable ends from said connector.

7. The connector of claim 6 wherein said end retainer comprises an end cap for holding said retaining members in close proximity to each other.

8. The connector of claim 6 wherein said end retainer comprises a clamping means for clamping the ends of said retaining members.

9. The connector of claim 6 wherein said end retainer is removably attached to said frame member.

10. The connector of claim 6 wherein said retainer comprises a portion of an apparatus of which said connector is a component.

11. The connector of claim 6 wherein said relief means comprises a camming member engagable with said spring means whereby said spring means is retractable from engagement with said force spreading means.

12. The connector of claim 6 wherein said connector comprises a retaining means engaged with said frame and said end retainer.

13. The connector of claim 12 wherein said retaining means comprises a threaded bolt.

14. The connector of claim 6 wherein said spring means comprises a plurality of leaf springs.

15. The connector of claim 14 wherein at least one of said leaf springs comprises at least a comb of springs disposed to act on springs of an adjoining comb of springs.

16. A connector for electrically joining two electrical cables comprising:

a frame comprising a rigid member having an exterior and having a long axis disposed transverse to an axis of conductors of said cables, said rigid member comprising a pair of retaining members forming a chamber extending parallel to said long axis, said retaining members extending one on each side of said cables and disposed parallel to said axis of said chamber;

force spreading means for equalizing forces on said cables insertable within said chamber and disposed on at least one side of said cables;

spring means disposed on said frame and further engageable with said force spreading means;

relief means for relieving forces of said spring means, thereby permitting positioning of said cables and said force spreading means in said chamber, application of said force to said cables to connect said conductors on said cables, and relieving said force to permit removal of said cable ends from said connector.

* * * * *